US006033211A

United States Patent [19]

Meyer

[11] Patent Number: 6,033,211

[45] Date of Patent: Mar. 7, 2000

[54] EMITTER APPARATUS

[75] Inventor: Jens-Uwe Meyer, Suffield, Conn.

[73] Assignee: Infratech, LLC, Atlanta, Ga.

[21] Appl. No.: 09/304,498

[22] Filed: May 3, 1999

Related U.S. Application Data

[63] Continuation-in-part of application No. 09/280,427, Mar. 29, 1999, which is a continuation-in-part of application No. 09/193,183, Nov. 16, 1998.

[51] Int. Cl.[7] ..... F23D 14/12

[52] U.S. Cl. ..... 431/329; 431/25; 431/69; 431/78; 432/59; 126/92 AC

[58] Field of Search ..... 431/326, 328, 431/329, 77, 78, 25, 69, 264; 126/92 R, 92 AC, 91 R, 92 B; 432/59, 8, 226; 34/519, 266

[56] References Cited

U.S. PATENT DOCUMENTS

| | | | |
|---|---|---|---|
| 3,162,430 | 12/1964 | Wilkerson | 431/329 |
| 3,321,001 | 5/1967 | Vezzoli | 431/328 |
| 3,422,811 | 1/1969 | Strand | 126/92 R |
| 4,378,207 | 3/1983 | Smith | 432/59 |
| 4,628,900 | 12/1986 | Arndt | 431/328 |
| 5,090,898 | 2/1992 | Smith | 431/328 |
| 5,393,222 | 2/1995 | Sutton | 431/328 |

*Primary Examiner*—James C. Yeung
*Attorney, Agent, or Firm*—Howard J. Greenwald

[57] ABSTRACT

An apparatus for drying a moving substrate containing a multiplicity of infrared emitters and a detection emitter and a device for supplying a mixture of air and gas to these emitters. The detection emitter contains an emitter body with a diffuser for distributing a fuel-oxygen containing gas mixture, a primary radiator having a combustion surface integrally connected to the emitter body, a first detection electrode, and a second detection electrode; each of these detection electrodes sends a signal to a control means when it senses the presence of flame-induced ionization. If the control means receives a signal from one but not both of these detection electrodes, it will continue supplying the air/gas mixture to the emitters. However, only when the control means ceases receiving a signal from both of the detection electrodes will it ceases allowing the supply of the air/gas mixture to the emitters.

11 Claims, 7 Drawing Sheets

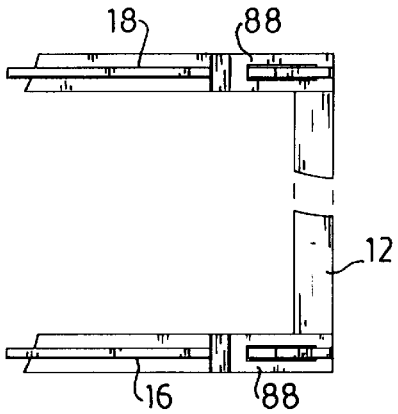
FIG. 8
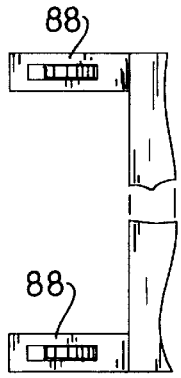
FIG. 9
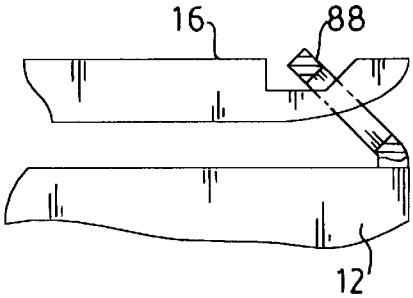
FIG. 10
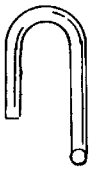
FIG. 11
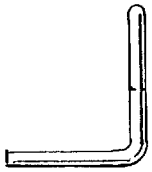
FIG. 12
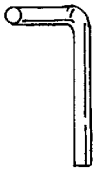
FIG. 13
FIG. 14
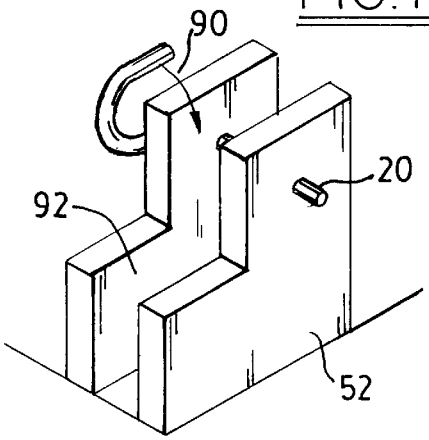
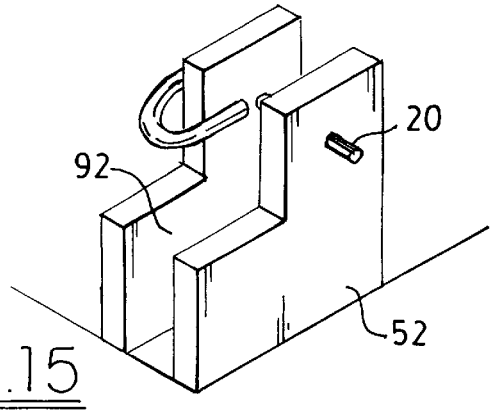
FIG. 15

EMITTER APPARATUS

CROSS-REFERENCE TO RELATED PATENT APPLICATION

This application is a continuation-in-part of applicant's copending patent application U.S. Ser. No. 09/280,427, filed Mar. 29, 1999, which in turn was a continuation-in-part of U.S. Ser. No. 09/193,183, filed Nov. 16, 1998.

FIELD OF THE INVENTION

A gas fired infrared radiation emitter with a removable reverberating screen and a primary radiating surface adapted to function either with or without the reverberating screen.

BACKGROUND OF THE INVENTION

Gas fired infrared radiation emitters are widely used in the pulp and paper industry for the drying of coatings on moving cellulosic webs. These emitters are well known; thus, for example, one such emitter is described in U.S. Pat. No. 5,820,361 of Daniel M. Lavigne et al.

The prior art infrared radiation emitters often contain a reverberating screen (or "grating") which increases the radiant power output of the emitter while simultaneously protecting the primary radiating surface from contamination. In some of the prior art embodiments, the screen is integrally connected to the emitter; thus, in these embodiments, when the screen fails due to excessive temperature, contamination, and/or normal wear and tear, the entire emitter must be replaced. When this occurs, not only must one bear the expense of a brand new emitter, but one loses a substantial amount of production time while replacing the emitter.

In the device disclosed in Belgium patent 09501070, an emitter with a removable grating is disclosed (see, e.g., column 1 of U.S. Pat. No. 5,820,361). However, as the patentees of U.S. Pat. No. 5,820,361 disclosed, the device of such Belgium patent was essentially inoperable in that "During tests at high temperatures this radiant however exhibited a risk of the grating falling, such fall then necessitating stopping the drying installation" (see lines 29–31 of Column 1 of U.S. Pat. No. 5,820,361).

The expressed objective of U.S. Pat. No. 5,820,361 is to remedy the screen falling problem. Thus, at lines 10–40 of Column 7 of such patent, it is disclosed that "The heat emitter . . . represented in FIGS. 1 through 4 has numerous advantages . . . . These advantages are . . . The risk of the screen or grating falling is almost nil."

However, despite this expressed objective, none of the embodiments depicted in this patent in fact contained a removable screen which did not fall during high temperature use. Heat emitters corresponding to the claimed embodiments in this patent were sold by IDS International, Inc. of Windsor Locks, Conn. under the name of "OPTIRAY GAS EMITTER"; however, during high temperature use of these emitters (in excess of 2,000 degrees Fahrenheit), a substantial number of the removable screens on such emitters invariably fell off.

In applicant's copending U.S. patent application U.S. Ser. No. 09/193,183, there is disclosed a gas fired infrared emitter with a removable screen which does not fall off during high temperature use. This particular emitter can be used with our without a screen; and it is an object of this invention to disclose a whole range of emitters with removable screens, each of which can be used with or without a screen.

In applicant's copending U.S. patent application U.S. Ser. No. 09/280,427, there is disclosed a gas fired infrared emitter which is comprised of an emitter body provided with a diffuser for distributing a fuel-oxygen containing gas mixture, a specified primary radiating surface, and a screen removably connected to such emitter body.

The emitters disclosed in patent applications U.S. Ser. Nos. 09/280,427 and 09/193,183 are substantial improvements over the prior art emitters. It is an object of this invention to provide a novel emitter which, in addition to containing the novel features described in applicant's copending patent applications, also contains novel and reliable means for detecting when the emitters are combusting gas.

BRIEF DESCRIPTION OF THE DRAWINGS

The invention will be described by reference to the specification and to the drawings, in which like numerals refer to like elements, and wherein:

FIG. 8 is partial top view of one end of the emitter of FIG. 1 illustrating another preferred means of securing the retaining bar, showing said rod disposed within a closed slot;

FIG. 9 is a partial top view of another end of the emitter of FIG. 8, with the rod omitted for the sake of simplicity of representation;

FIG. 10 is a partial side view of the emitter locking structure of FIG. 8;

FIGS. 11, 12, 13 are top views of various connectors which may be used in the devices of this invention;

FIGS. 14 and 15 illustrate one preferred connection means;

DESCRIPTION OF THE PREFERRED EMBODIMENTS

In the first part of this specification, applicant will refer to his drawings and describe a particular emitter which may be used. In the second part of this specification, applicant will describe other emitters which may be used and, in particular, will describe the preferred properties desired for the primary radiant emitting surface used therein. In the third part of this specification, applicant will describe a novel emitter which contains reliable and durable means for detecting when flame propagation has occurred in a series of such emitters.

Infrared emitters are well known to those skilled in the art and are described, e.g., in U.S. Pat. Nos. 5,520,536, 5,464, 346, 5,306,140, 4,830,651, 4,722,681, 4,654,000, 4,604,054, 4,589,843, 4,500,283, 4,039,275, 3,852,025, and the like. The disclosure of each of these United States patents is hereby incorporated by reference into this specification.

By way of further illustration, U.S. Pat. No. 5,820,361 of Daniel M. Lavigne et al. discloses a heat emitter comprising: (a) a back-body provided with a distributor for distributing a fuel-oxygen containing gas mixture, (b) an organ having a combustion surface, (c) a frame receiving at least partly said organ and connecting said back-body with said organ, (d) a screen, (e) at least a pair of flanges facing each other attached to said back-body, each flange provided with a hole, the hole of a first flange of said pair being distant from the hole of the second flange of said pair, and (f) at lest one sliding bar extending longitudinally between a first end part and a second end part opposite to said first end part, said sliding bar having a length greater than the distance separating the hole of a first flange of said pair from the hole of the second flange of said pair, said first end part and said second end part having respectively a cross section, adapted for being engaged in the hole of said first flange, and a cross section adapted for being engaged in the hole of a second flange. The entire disclosure of this Lavigne et al. patent is hereby incorporated by reference into this specification.

The device of this patent application is a substantial improvement over the device described and claimed in the Lavigne et al. patent. One preferred embodiment thereof will be described by reference to the Figures.

Figure 1:
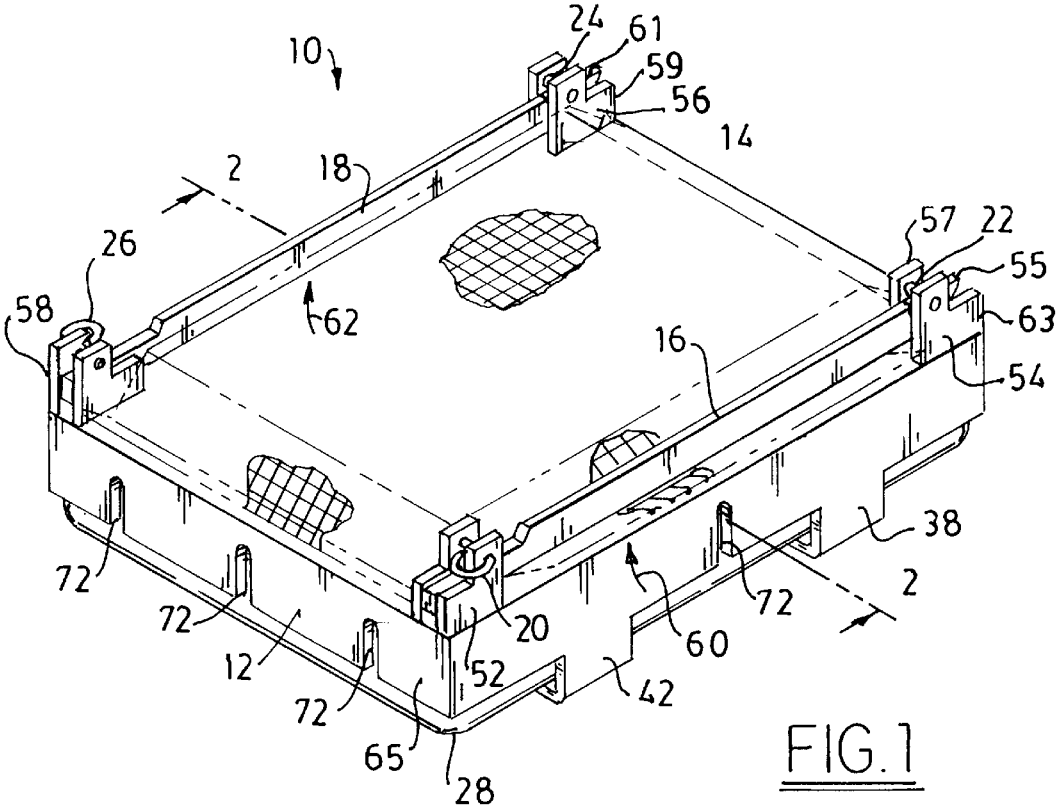
FIG. 1 is a perspective view of one preferred embodiment of the invention.

Referring to FIG. 1, it will be seen that emitter 10 is comprised of a frame 12, a screen 14 removably connected to the frame 12 by means of a first retaining bar 16 and a second retaining bar 18, each of which is removably connected to such frame 12 by means of connectors 20, 22 (retaining bar 16) and 24 and 26 (retaining bar 18). The frame 12 is integrally connected to back body 28.

Figure 2:
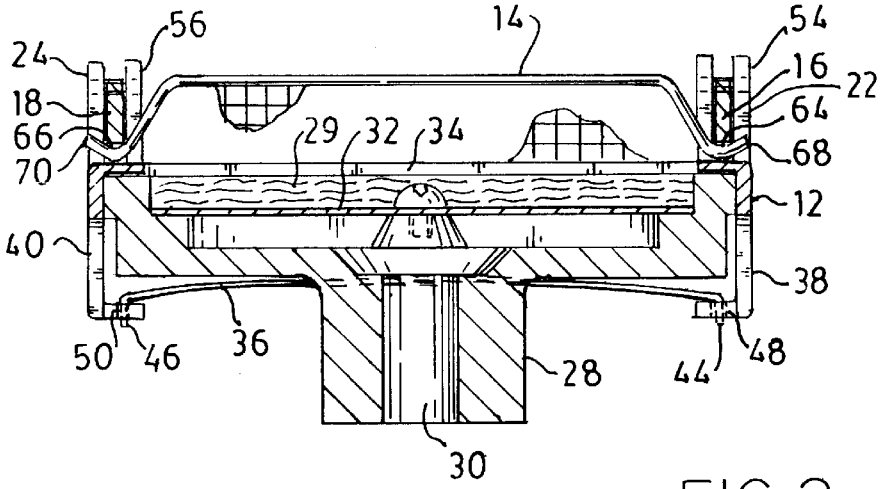
FIG. 2 is a sectional view of the embodiment of FIG. 1, taken along lines 2—2.
Figure 5:
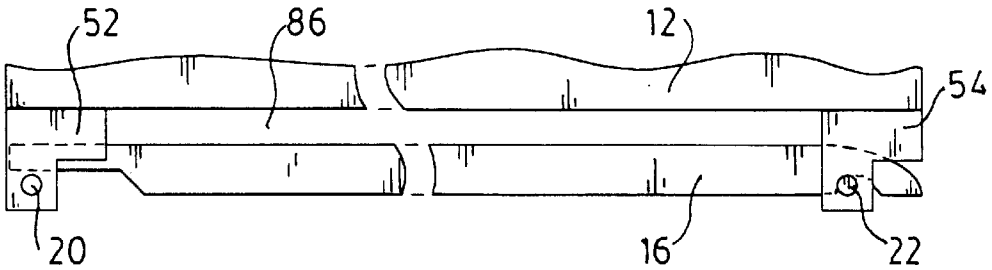
FIG. 5 is a second side view of the retaining bar/frame structure of FIG. 4 showing the emitter radiating downwardly.
Figure 7:
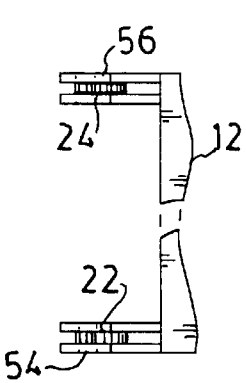
FIGS. 6 and 7 are top views of brackets which are integrally connected to the frame of the emitter of FIG. 1.

FIG. 2 is a sectional view of the emitter 10 of FIG. 1, taken along lines 2—2. It will be seen that a fuel-oxygen gas mixture 29 may be flowed through orifice 30 and diffuser 32.

The function of diffuser 32 is to equalize the pressure behind primary radiator 34. Combustion preferably occurs within primary radiator 34, which can consist essentially of metallic fiber, ceramic fiber, perforated ceramic material, etc. In the preferred embodiment illustrated in FIG. 1, the primary radiator 34 is a mat of sintered metal fibers with a thickness of about 3.0 millimeters. In one embodiment, the primary radiator has a surface area of about 48 square inches.

Referring again to FIG. 2, the back body 28 is preferably removably connected to frame 12. In the preferred embodiment depicted, a spring 36 is connected between a flange 38 integrally formed with frame 12 (see FIG. 1, and also FIG. 2), and an opposing flange 40 integrally formed with frame 12 (not shown in FIG. 1, but see FIG. 2). It will be apparent that the emitter 10 also contains a flange 42 (see FIG. 1) and an opposing flange (not shown) also connected by a spring (not shown).

Referring again to FIG. 2, it will be seen that spring 36 is comprised of a nubs 44 and 46 adapted to be removably disposed within orifices 48 and 50 of flanges 38 and 40. By means of the pressure exerted by spring 36, and by the corresponding spring on the other side of the emitter 10, the back body 28 is fixed within frame 12, and the primary radiator 34 is maintained in spaced apart relationship with diffuser 32. A gas-tight seal is formed between the frame 12 and the back body 28.

In the device depicted in U.S. Pat. No. 5,820,361, the flanges are mounted on the back body by means of screws. By comparison, and referring to FIGS. 1 and 2, slotted receptacles 52, 54, 56, and 58 are integrally formed with frame 12. This integral connection may be formed by conventional means such as, e.g. casting, welding, etc. Disposed within slotted receptacles 52 and 54 is bar 16. Disposed within slotted receptacles 56 and 58 is bar 18.

It is noteworthy that U.S. Pat. No. 5,820,361 explicitly teaches that the structure used in applicant's device should not work. Thus, at lines 35 to 44 of Column 3 of this patent, it is disclosed that "In the heat emitter of the invention, the body bears the flanges or lugs. Indeed, the frame is subjected to very high temperature and almost cannot be cooled, so that the expansion of the frame is liable to be significant. Thus, were the lugs mounted directly onto the frame, these lugs would undergo real movements or expansion, but equally movements due to the expansion of the frame. Too significant movements of expansion can be the cause of the disengagement of an extremity of a small bar out of the lug hole, and consequently the cause of a fall of the grating."

In applicant's claimed device, by comparison, and referring again to FIGS. 1 and 2, the back walls 55, 57, 59, and 61 of receptacles 54 (walls 55 and 57) and 56 (walls 59, and 61) are recessed from the end wall of frame 63 by a distance of preferably at least about 0.2 inches. The lengths of rods 16 and 18 are such that they extend at least from frame end 63 to frame end 65. Thus, even if the distance between receptacles 52 and 54, or between receptacles 56 and 58, were increased due to heat expansion of the frame 12, the bars 16 and 18 are sufficiently long that they will continue to be disposed within their respective slotted receptacles.

In one preferred embodiment, not specifically shown in FIGS. 1 and 2, bars 16 and 18 are so configured that there is some "play" between them and the connectors on each end of the frame 12. Thus, even if such bars do expand, they will remain disposed within their respective slotted receptacles and will still remain connected to their respective connectors. It is thus preferred that, in one embodiment, each of bars 16 and 18 can move in either direction at least about 0.15 inches, but preferably less than about 0.5 inches. In general, it is preferred that each of bars 16 and 18 be free to move in either direction for a distance which is at least about 1.5 percent of the total length of the bar 16, or the bar 18.

In the preferred embodiment depicted in FIGS. 1 and 2, it will be seen that frame 12 is comprised of a multiplicity of expansion slots 72. It will also be seen, by reference to the embodiment of FIG. 1, that the receptacles 52 and 58 are substantial mirror images of each other. As will be apparent to those skilled in the art, when a multiplicity of emitters 10 are placed side by side in rows, this mirror image arrangement allows one unimpeded access to fasteners 20 and 26.

In the preferred embodiment depicted in FIGS. 1 and 2, bar 16 is pivotally connected to frame 12 within receptacle 54 means of connector 22, which preferably is permanently affixed to such receptacle 54. Similarly, bar 18 is pivotally connected within receptacles 56 by means of connector 24, which preferably is permanently affixed to such receptacles 56.

By comparison, connectors 20 and 26 are preferably removable. Once they are so removed, each of bars 16 and 18 can be pivoted upwardly in the direction of arrows 60 and 62 and thereafter removed. After the removal of bars 16 and 18, a spent screen 14 may be removed, a new screen 14 may be inserted, the bars 16 and 18 may be reinserted within their respective receptacles and locked into place by connectors 20 and 26.

When bars 16 and 18 are locked into the position depicted in FIGS. 1 and 2, the screen 14 is firmly locked into place.

It will be seen that the screen 14 has a multiplicity of concave surfaces 64 and 66 disposed near the ends 68 and 70 of the screen and adapted to receive the bars 16 and 18, respectively.

Figure 3:
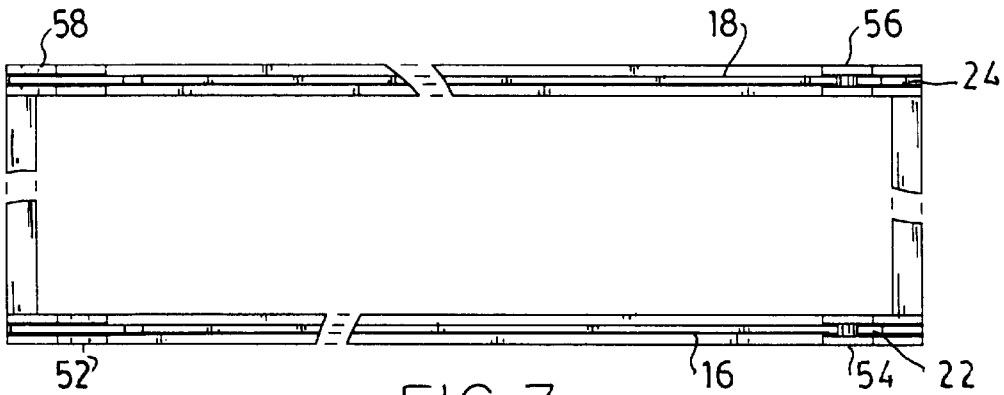
FIG. 3 is a top view of the frame of the emitter of FIG. 1.
Figure 4:
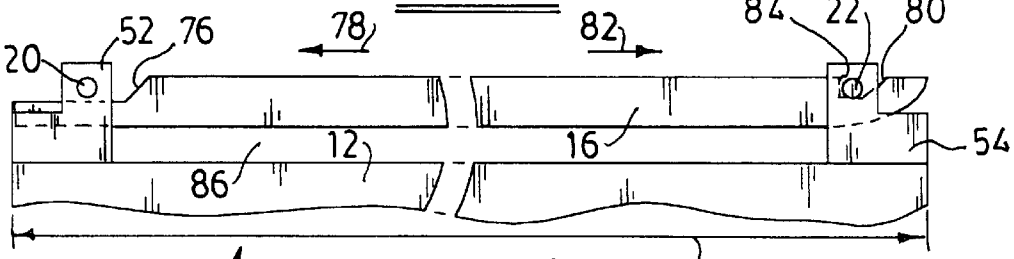
FIG. 4 is a first side view of the retaining bar within the frame of FIG. 3 of the embodiment of FIG. 1 showing the emitter radiating upwardly.
Figure 6:
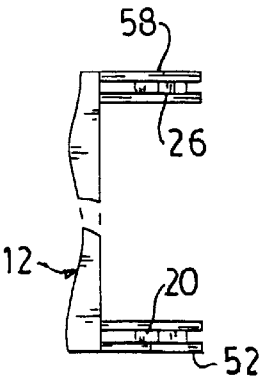

FIG. 3 is a top view of the frame of the emitter of FIG. 1. FIG. 4 is a first side view of the retaining bar 16 within the frame of FIG. 3. It will be seen that, in this embodiment, bar 16 has several preferred features which prevent its disengagement from receptacles 28 and 32.

In the first place, bar 16 has a length 74 which is at approximately equal length of the frame 12. It may be a bit shorter than frame 12, but it should not be any longer.

Bar 12 preferably has an inclined surface 76 which, when bar 12 moves in the direction of arrow 78, acts as a stop against connector 20. However, because there is some distance between surface 76 and connector 20, there is some "play" room within which bar 16 can move due to heat expansion.

Similarly, bar 12 has an inclined surface 80 which acts as a stop against connector 22 when bar 16 is moved in the direction of arrow 78. Conversely, when bar 16 is moved in the direction of arrow 82, surface 84 acts as a stop against connector 22.

When connector 20 is removed from receptacle 52, then one can readily pivot bar 16 upwardly in the direction of arrow 60 and readily disengage the bar from slotted receptacle 54.

As will be apparent to those skilled in the art, the opposing bar 18 (not shown in FIGS. 3–7) works in substantially the same manner as bar 16.

Referring again to FIGS. 4 and 5, screen 14 is disposed within space 86 and clamped between rods 16 and 18, and frame 12 (also see FIGS. 1 and 2).

FIGS. 8, 9, and 10 disclose another preferred means of removably attaching bars 16 and 18 to the frame 12. In this embodiment, instead of using the slotted receptacles 54 and 56 depicted in FIGS. 1 and 2, one may use the inclined slotted receptacle 88 best illustrated in FIG. 10. As will be apparent, this arrangement will not require a connector, such as connectors 22 and 24.

FIGS. 11, 12, and 13 illustrate several of the many connectors which may be used in the apparatus of this invention.

FIGS. 14 and 15 illustrate one means of removably connecting a bar 16 (not shown) within slotted receptacle 52. The connector 20 depicted in FIG. 14 may be twisted in the direction of arrow 90 so that the connector 20 is removably locked around wall 92 of slotted receptacle 52.

Although the novel removable locking structure of this invention has been shown with regard to one particular emitter with a frame, it will be apparent that it may be used with any emitter with a frame. Thus, the locking structure could readily be used with the emitters sold by the Impact Systems Company of California, with the emitters sold by the Optimization Technologies Company of Marietta Ga. (which are sold under the name of "DURANIT" emitters), with the emitters sold by the Krieger Corporation of Enfield, Conn., with the emitters sold by the Marsden Corporation of Pennsauken, N.J., with the emitters sold by the Innovative Drying Systems Company of Belgium, with the emitters sold by IDS International, Inc. of West Chester, Ohio, with the emitters sold the Solaronics Company of Armentieres, France as well as their subsidiary company in the United States, and the like.

A novel emitter with a specified primary radiating surface

In the first part of this specification, applicant has described one preferred emitter which can be used with or without a screen. As is well known to those skilled in the art, this is a very advantageous property because it gives a user substantial flexibility in meeting his process needs.

When an emitter is used with a screen, it has the advantages described elsewhere in this specification. However, it also has certain disadvantages, including the fact that it creates a substantially increased risk of fire because of the relatively high mass of the screen wire, which causes it to take a relatively long time to cool down below the ignition temperature of the substrate being dried (such as paper).

When an emitter is used without a screen, it will always cool down more quickly than an emitter with a screen, thereby reducing the risk of combusting the substrate. However, the screenless emitter is significantly less energy efficient and is more susceptible to contamination by, e.g., volatile coatings on the substrate.

For some applications, the emitter with a screen is clearly preferred; for other applications, the emitter without a screen is clearly preferred. It is desirable that a particular user be able to readily switch from one configuration to another without the need to remove and/or reinstall emitters from the production line.

Applicant has discovered and developed a "convertible emitter" which gives a user the desired flexibility. One embodiment of this emitter is disclosed in the first part of this specification; other embodiments are disclosed in this portion of the specification.

Critical to the success of applicant's "convertible emitter" are at least two factors: the presence of means for readily removing and attaching a screen, and the use of a particular primary radiating surface adapted to be used either with or without a screen.

In one embodiment, there is provided a gas fired infrared radiation emitter comprising:

(a) an emitter body comprised of a diffuser for distributing a fuel-oxygen containing gas mixture, (b) a primary radiator having a combustion surface, (c) a frame receiving at least partly said primary radiator, (d) means for attaching a screen to said emitter body, and (e) means for removing a screen from said emitter body.

In this embodiment of the invention, one can use any gas-fired emitter with a screen which can be readily attached or removed. Thus, by way of illustration and not limitation, and provided that the primary radiating surface used is appropriate, one may use the gas fired emitter described in Belgium patent 09501070 and/or in U.S. Pat. No. 5,820,361. Additionally, provided that proper modification thereof is made as described hereinafter, one may use the gas-fired emitter sold as "Optiray Emitter" by the IDS International, Inc. of West Chester, Ohio.

The "Optiray Emitter" has been sold since 1995. Since 1995, at least about 80 percent of the gas-fired emitters with removable screens which have been sold have been this "Optiray Emitter." However, despite this relatively long period of time and the substantial number of sales made, no one in the prior art has suggested a means of providing an emitter which not only has a removable screen but also is capable of being used with or without a screen.

It is believed that one reason for this failure of the prior art was that, if the Optiray Emitter configured as sold were to be used without a screen, it would be substantially less efficient than comparable gas-fired emitters which are sold without screens. These "screenless emitters" are widely available and are sold by such companies as Marsden, Inc. of Pennsauken, N.J. (which sells a vacuum-formed ceramic fiber based emitter). The unmodified Optiray Emitter, when used without a screen, is at least about 25 percent less efficient than the Marsden emitter.

The radiating surface used in the Optiray Emitter is not suitable for use without a screen, as evidenced by the poor efficiencies which result. By comparison, it the radiating surface used in the Marsden, Inc. were to be used with a screened emitter, it would readily degrade and cease to function within a period or hours.

Applicant has discovered a particular "convertible emitter" which utilizes a particular radiating structure.

The particular radiating structure used preferably will be in the form of a mat of sintered fibers, such as, e.g., the mat depicted in FIG. 1 as element 29.

The mat used in this embodiment of the invention is comprised of interlocking inorganic fibers. As used herein, the term "fiber" refers to a structure which has a length at least 100 times its diameter or width and whose length is at least 0.2 inches (0.5 centimeters). The term inorganic, as used herein, refers to a material which does not contain carbon and includes, e.g., fibers made from metal, metal alloys, oxide materials such as alumina, and the like.

The preferred mat has a substantial amount of porosity. In one embodiment, from about 9 to about 50 volume percent of the mat is comprised of the inorganic fibrous material. In a preferred aspect of this embodiment, from about 9 to about 35 volume percent of the mat is comprised of inorganic fibrous material. Measurements of the porosity of mat may be made by well known conventional means.

One preferred mat with the desired degree of porosity is sold by the Technetics Corporation of 1600 Industrial Drive, Deland, Fla. 32724. The mats sold by this company consist essentially of a sintered fibrous material which contains iron, chromium, aluminum, and yttrium. One of the mats so sold has a thickness of 0.2" and a porosity of 90%, and it is made from 4 mil fiber. Another of the mats so sold has a thickness of 0.12" and a porosity of 86.7 percent, and it is also made from 4 mil fiber.

The mat used in the apparatus of this invention preferably has a thickness of from about 0.08 inches to about 0.5 inches.

In one embodiment, the ratio of the porosity of the mat (in volume percent) to its thickness (in inches) ranges from about 300 to about 900 and, preferably, from about 350 to about 850. In one embodiment, the ratio of the porosity to the mat thickness is from about 400 to about 800.

The sintered fiber used to make the mats preferably have a maximum dimension (such as a diameter) of from about 700 microinches to about 0.012 inches. In one embodiment, the diameter of the sintered fiber ranges from about 700 microinches to about 3500 microinches. In another embodiment, the diameter of the sintered fiber ranges from about 0.001 to about 0.006 inches.

The preferred emitter has a radiant efficiency which varies depending upon whether it is used with the removable screen, or without the removable screen. As used in this specification, the term radiant efficiency refers to a radiant efficiency measured using a heat input of 65,000 British Thermal Units per hour per square foot using an amount of air which is 108% higher than the stoichiometric amount required to fully combust the gas.

When the emitter is used without the removable screen, it has a conversion efficiency of from about 25 to about 44 percent. When it is used with the removable screen, it has a radiant efficiency of from about 40 to about 52 percent. To the best of applicant's knowledge, no prior art emitter has this combination of efficiencies both with and without removable screens.

The radiant efficiency of an emitter may be measured by conventional means such as, e.g., the means described in U.S. Pat. Nos. 5,797,997, 5,767,620, 5,512,108, 5,137,583, and the like. The disclosure of each of these United States patent is hereby incorporated by reference into this specification. Reference also may be had to an article published by Normand Bedard entitled "Laboratory Testing of Radiant Gas Burners and Electric Infrared Emitters" which appeared in Experimental Heat Transfer, 11:255–279 (1998); the test procedure described in this article is the preferred test procedure.

The radiant efficiency of an emitter is determined by the ratio of the amount of energy furnished to the emitter, and the amount of infrared radiant energy emitted by the emitter.

The response time of the emitter of this invention will also vary depending upon whether it is used with a screen. As is known to those skilled in the art, the response time is the time it takes the emitter to reach its operating temperature after energy is introduced into it; it is also the amount of time the emitter takes to cool to below the ignition temperature of the substrate after energy has been withdrawn from it. See, e.g., U.S. Pat. Nos. 5,474,517 and 5,196,676, the entire disclosures of which are hereby incorporated by reference into this specification. Also see the aforementioned article by Normand Bedard.

The emitter of this invention, with a screen, will reach an operating temperature of 2,000 degrees Fahrenheit after heat is applied within less than 60 seconds; thus, its "heat up response time" is less than 60 seconds. Without a screen, the emitter reaches its operating temperature of 1,750 degrees Fahrenheit in less than 30 seconds.

After the heat source is removed from the emitter, when is contains a screen it cools to a temperature of below 500 degrees Fahrenheit in less than 60 seconds; thus, its "cool down" response time is less than 60 seconds. When it does not have a screen, it cools to a temperature of below 500 degrees Fahrenheit in less than 30 seconds.

A process for determining the absence of flame within a bank of emitters

U.S. Pat. No. 3,740,574 of Jonathan Todd Taylor discloses a flame monitor which uses the principle of flame ionization for determining the presence or absence of a flame. The entire disclosure of this patent is hereby incorporated by reference into this specification.

As is disclosed in the Taylor patent, in many applications, flame combustion of fuels is used as a source of heat; it is so used with infrared emitters where a multiplicity of such emitters (often up to 50 or more of such emitters in a row) are used to dry a moving web of paper.

In such applications, it is essential that there be at no time a sizable accumulation of unburned fuel in any of the combustion zones of the emitters. Thus, for example, the Occupational Safety and Health Administration (OSHA) have established codes requiring the limits to which any such unburned fuel may exist.

In a row of gas-fired emitters, the emitters are sequentially ignited, one to the next. If one emitter in a row fails to ignite, then this emitter, and every emitter following it, will accumulate unburned gas. In order to detect this phenomenon, flame monitors have been developed which exploit the fact that an ionizing process occurs within the flame due to the fuel combustion.

These flame monitors are often referred to as "flame rods" or "detection electrodes." These devices are well known in the art and are described, e.g., in U.S. Pat. Nos. 5,658,140, 5,345,830, 5,335,559, 5,328,375, 5,320,536, 5,266,033, 5,233,869, 5,017,130, 4,983,124, 4,737,102, 4,588,372, 4,147,494, 3,942,939, 3,941,553, 3,940,242, 3,836,857, 3,836,316, 3,740,574, 3,647,196, 3,576,556, and the like. The disclosure of each of these United States patents is hereby incorporated by reference into this specification.

Figure 16:
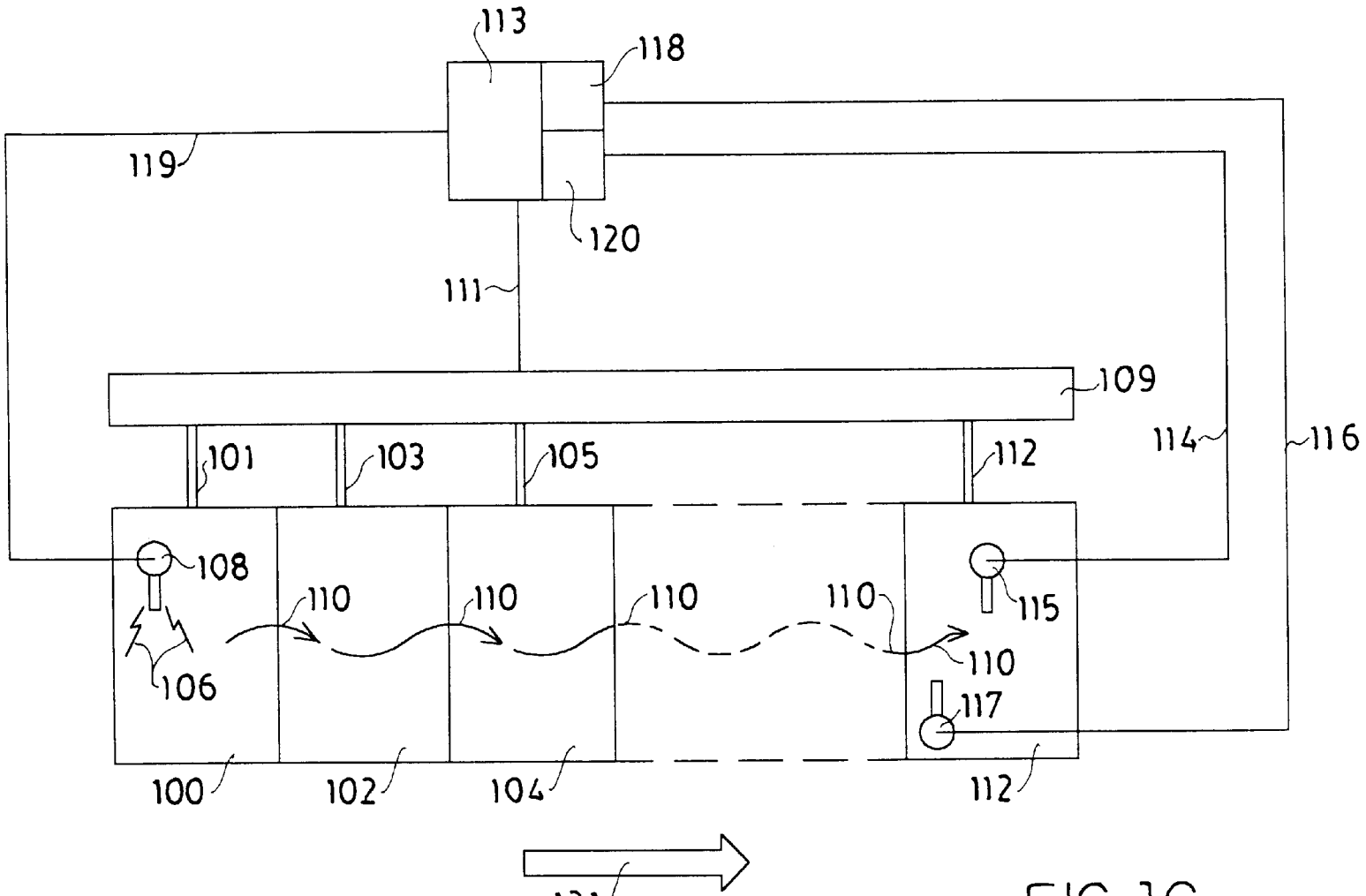
FIG. 16 is a schematic of a preferred process for insuring that, in a bank of gas-fired emitters, flame propagation in such emitter bank has occurred.

FIG. 16 is a schematic representation of a flame detection process. Referring to FIG. 16, it will be seen that gas fired emitters 100, 102, and 104 are disposed adjacent to each other in series; only three such emitters are shown in this Figure for the sake of simplicity of representation, but many more emitters could be used. Typically, from 15 to about 60 such emitters are used in a bank of emitters.

Each of the emitters 100, 102, 104, and 112 is fed a mixture of gas and air through tubes 101, 103, 105, and 107; the air gas mixture is formed in manifold 109, which is operatively connected via line 111 to controller 113. The controller 113, under certain conditions, will receive a signal from either electrode 115 and/or electrode 117 which will cause it to cease supplying the air gas mixture to emitters 100, 102, 104, 112, etc.

The controller 113 may be any of the flame safety units which are commercially available such as, e.g., the flame safety units manufactured by the Honeywell Company. Thus, by way of illustration and not limitation, the controller may be similar to or identical to one or more of the controllers described in U.S. Pat. Nos. 5,718,256, 5,660,542, 5,640,948, 5,598,833, 5,568,805, 5,462,044, 5,035,607, 4,252,300, 3,941,553, 3,767,354, and the like. The disclosure of each of these United States patents is hereby incorporated by reference into this specification.

The prior art controller units contain differing programs. In the process of the instant invention, a control program is utilized which will only shut off the gas supply to emitters 100, 102, 104 et seq. when the controller 113 ceases to receive a signal from both of electrodes 115 and 117. The use of conventional logic circuits to effect this result is well within the skill of those in the art.

Referring again to FIG. 16, a spark 106 is discharged from spark source 108; spark source 108 is operatively connected to controller 113 by line 119. Spark source 108 may, e.g., be an igniter electrode which is activated by a high-voltage source. Typically about 10,000 volts is used to activate the igniter electrode.

One may use any conventional igniter electrode as electrode 108. Thus, by way of illustration, one may use one or more of the igniter electrodes described in U.S. Pat. Nos. 5,770,000, 5,119,802, 5,033,454, 4,949,705, 4,906,175, 4,850,856, 4,746,285, and the like. The entire disclosure of each of these United States patent is hereby incorporated by reference into this specification.

Referring to FIG. 16, the spark 106 will cause ignition within emitter 100; and, if everything goes as desired, the flame 110 will propagate to emitter 102, and then to emitter 104, and to and through the other emitters in the bank of emitters and in the direction of arrow 121 until it reaches flame detection emitter 112. The structure of this flame detection emitter 112 is described in more detail elsewhere in this specification.

Referring again to FIG. 16, it will be seen that flame detection emitter 112 is comprised of detector electrodes 115 and 117. When the flame has properly propagated down the bank of emitters 100, 102, 104 et seq., then each of detector electrodes 115 and 117 will sense the presence of ions. As is disclosed in U.S. Pat. No. 3,740,574, an ionizing process occurs within the flame due to the fuel combustion. In the combustion process, excess energy is liberated by the combining of two or more elements to form a compound with a lower potential energy level. Ions, taking the form of electrons and positive atomic nuclei, are formed by the heat of the combustion process.

The detector electrodes 115 and 117 detect the presence of such ions. As long as they continue to detect the presence of such ions, they each furnish a positive signal (via lines 114 and 116) to the controller 113; and as long as controller 113 continues to receive such positive signals, it continues to allow the supply of the air/gas mixture to the emitters 100, 102, 104 et seq. However, if the controller 113 ceases to receive a positive signal from both of detectors 115 and 117, it will cause the supply of air and gas to the emitters to cease.

The cessation of the air/gas supply to the emitters creates substantial problems. In many applications, the banks of emitters are used to dry webs of paper moving at speeds as high as 5,000 feet per minute across a web width of about 30 feet or more. When the drying portion of the process is shut down, the paper used in the process generally must be reprocessed in a pulper and then reintroduced onto the paper machine. A shutdown of a typical paper drying process for a period as little as 60 minutes can often cause a financial loss of at least about fifty thousand dollars. Consequently, there is a strong motivation to minimize unscheduled shut downs and, when such shut downs do occur, to minimize their duration.

Referring again to FIG. 16, the prior art detector emitters 112 generally only contained one detector electrode, such as detector electrode 117. Furthermore, in the prior art devices, the detector electrodes were generally integrally connected to their associated electrode assemblies; and the electrode assemblies were integrally connected to the emitters. Thus, when a particular detector electrode went bad and caused the shut down of the drying process, one would have to replace the emitter of which it was an integral part. Such replacement often took an hour or more; and it usually necessitated the use of a new emitter which often costs more than about seven hundred dollars.

By comparison, in applicant's preferred process, the electrode assembly has an electrode which is removably attached to such assembly and thus can readily be removed and replaced without the need for replacing the entire emitter; such replacement generally can take place in a matter of several minutes. Furthermore, in applicant's preferred process unless neither of electrodes 115 and 117 is detecting ions and sending a signal to controller 113, then the controller 113 will continue to allow the supply of air and gas to emitters 100, 102, 104 et seq.

As is known to those skilled in the art, electrodes such as electrodes 115 and 117 often cease to operate because of high temperature oxidation conditions and/or the presence of environmental contaminants. Because of fouling with either oxidation products and/or other reaction products, the ability of the electrode to sense the presence of ions is often diminished.

These electrodes often have service lives of as little as three months; but they also often last as long as a year or more. The failure rate for any particular electrode is substantially unpredictable, and it is rare to have two electrodes fail at substantially the same time, even when they have been subjected to the same conditions for the same time periods. Thus, in applicant's process, even when one of the electrodes shuts down, it is unlikely that both will shut down at the same time.

Referring again to FIG. 16, and in the preferred embodiment depicted therein, it will be seen that flame safety controller 113 is comprised of flame safety unit 118 and flame safety unit 120. In the embodiment depicted, flame safety unit 118 is comprised of a first switch, and flame safety unit 120 is comprised of a second switch.

Figure 17:
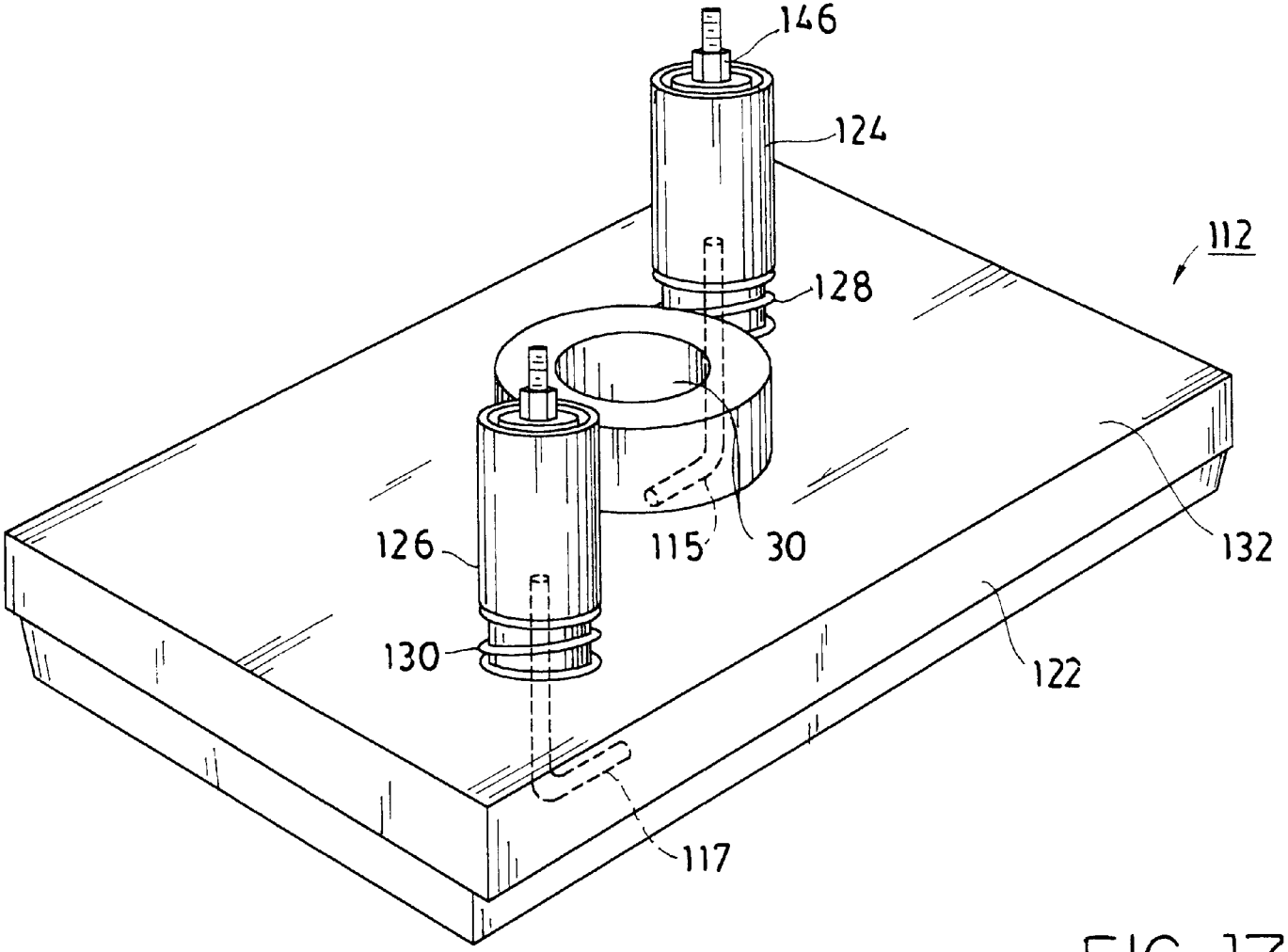
FIG. 17 is a schematic view of one preferred emitter of this invention.

FIG. 17 is a schematic representation of a detection emitter 112. The body 122 depicted therein is substantially identical to the emitter body depicted in FIG. 1, but unnecessary detail has been omitted therein for the sake of simplicity of representation.

Referring to FIG. 17, it will be seen that detection emitter 112 is comprised of electrode 115 and electrode 117, each of which is disposed within electrode sleeve 124 and 126, respectively. It will be seen that steel springs 128 and 130 which are disposed between the electrode sleeves 124 and 126 and the base 132 of the emitter.

Figure 18:
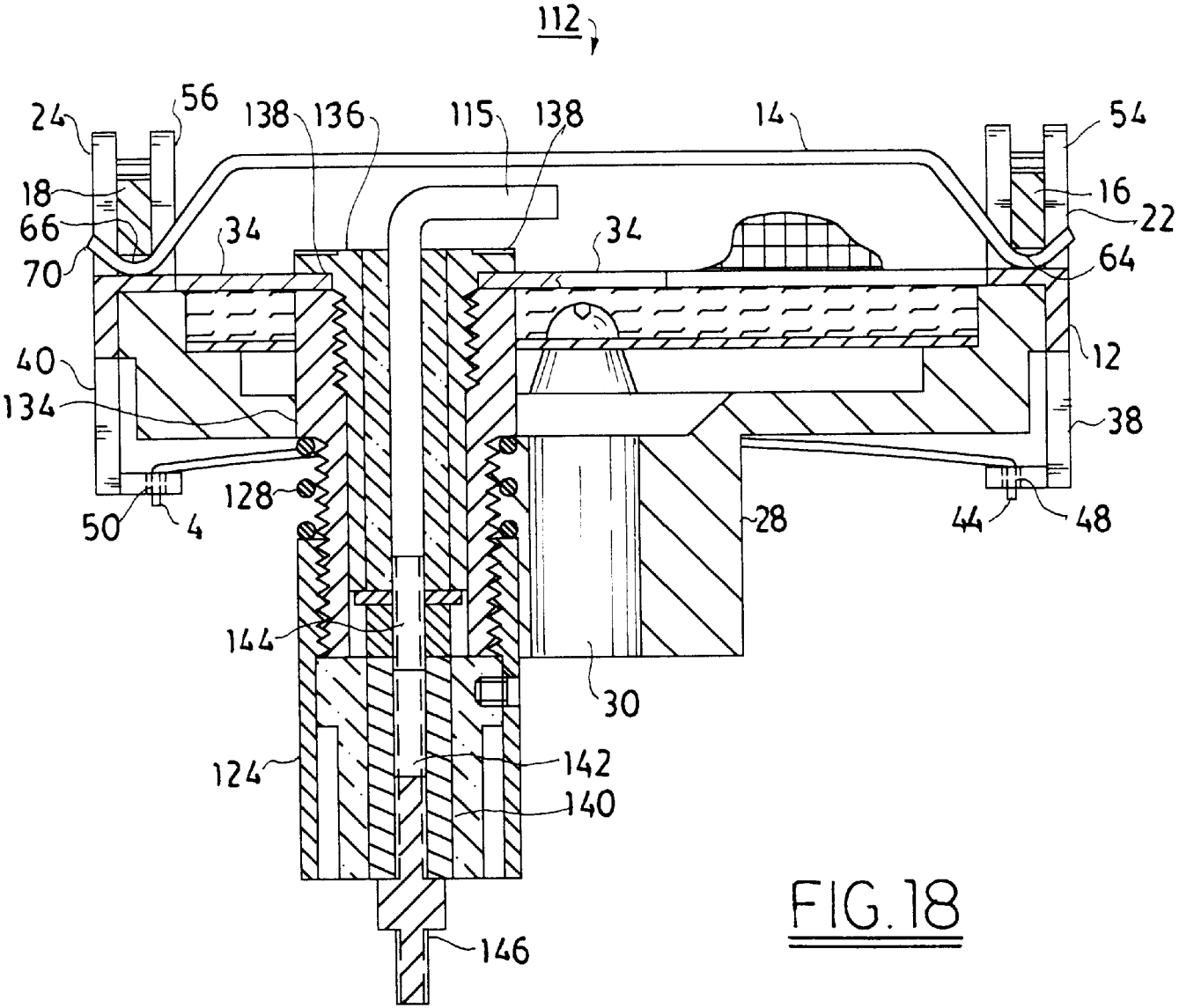
FIG. 18 is a sectional view of the emitter of FIG. 17.
Figure 19:
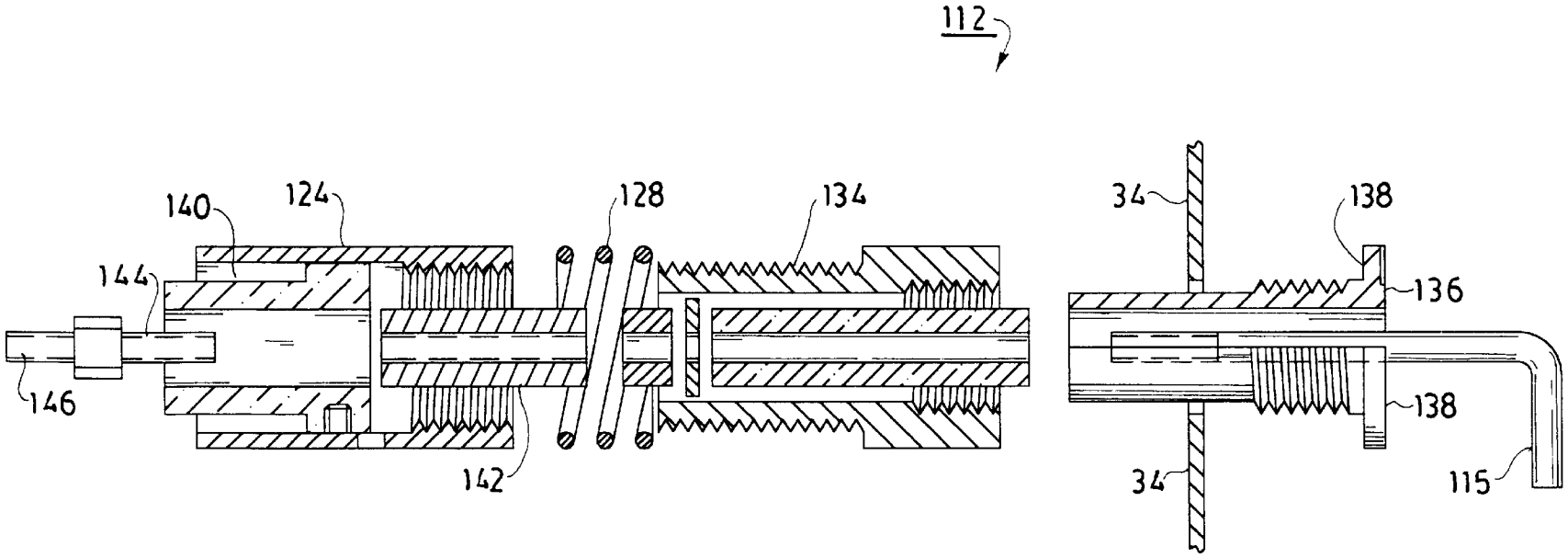
FIG. 19 is an exploded view of the emitter of FIG. 17.

FIG. 18 is a sectional view of detection emitter 112 from which, for the sake of simplicity of representation, only electrode 115 has been shown. It will be apparent that, in this preferred embodiment, both electrodes 115 and 117 are present (see FIG. 17).

Referring to FIG. 18, bushing 134 is inserted through an orifice disposed within base 132 of emitter 112. This orifice generally is about 0.75 inches in diameter and about 0.25 inches deep.

Once bushing 134 has been inserted through base 132, then bushing 136 is disposed within bushing 134 and through an orifice in mat 34; the orifice generally has a diameter of about 0.7 inches. It will be seen that lip 138 of bushing 136 will clamp mat 34 between such lip 138 and bushing 134.

Once bushing 136 has been disposed within bushing 134, then spring 128 is disposed over bushing 134. Thereafter, sleeve 124 is threaded onto the protruding end of bushing 134, thereby compressing spring 128.

Thereafter, ceramic receptacle 140 is disposed within sleeve 124 and locked into place therein by means of rivets (not shown) Thereafter, flame rod 115 is removably attached to the ceramic receptacle 140 through its insertion into bushing 136. The flame rod 115 protrudes through a portion of bushing 134.

In the preferred embodiment depicted, ceramic receptacle 140 is comprised of a threaded insert 142 which can be used to removably engage flame rod 115 by means of exterior threads 144. In this embodiment, the flame rod 115 can be readily removed from the assembly.

Referring again to FIG. 18, threaded connector 146 is removably connected to threaded insert 142.

FIG. 18 depicts one preferred assembly in which a detector electrode, such as electrode 115, can be removably attached to the assembly. As will be apparent to those skilled in the art, other such assemblies can be used, and they also are within the scope of the instant invention.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An apparatus for drying a moving substrate comprised of a first infrared emitter, a second infrared emitter adjacent to said first infrared emitter, a third infrared emitter adjacent to said second infrared emitter, a detection emitter, means for supplying a mixture of gas and air to each of said first infrared emitter, said second infrared emitter, said third infrared emitter, and said detection emitter, control means, and means for igniting said mixture of gas and air supplied to said first infrared emitter, wherein:

(a) said detection emitter is comprised of an emitter body comprised of a diffuser for distributing a fuel-oxygen containing gas mixture, a primary radiator having a combustion surface integrally connected to said emitter body, a first detection electrode, and a second detection electrode, wherein:

1. each of said first detection electrode and said second detection electrode is operatively connected to said control means,
2. each of said first detection electrode and said second detection electrode sends a signal to said control means when it senses the presence of ions,
3. when said control means ceases receiving a signal from either said first detection electrode or said second detection electrode, it will not interrupt the supply of said mixture of gas and air to each of said first infrared emitter, said second infrared emitter, said third infrared emitter, and said detection emitter, and
4. when said control means ceases receiving a signal from both of said first detection electrode and said second detection electrode, it will interrupt the supply of said mixture of gas and air to each of said first infrared emitter, said second infrared emitter, said third infrared emitter, and said detection emitter.

2. The apparatus as recited in claim 1, wherein said detection emitter is comprised of a screen removably attached to said emitter body.

3. The apparatus as recited in claim 2, wherein said combustion surface of said primary radiator is in the form of a mat of interlocking fibers which has a porosity of from about 50 to about 91 volume percent and a thickness of from about 0.08 to about 0.5 inches.

4. The apparatus as recited in claim 3, wherein the ratio of said porosity to said thickness is from about 300 to about 900.

5. The apparatus as recited in claim 4, wherein said detection emitter is comprised of a frame within which said primary radiator is disposed.

6. The apparatus as recited in claim 5, wherein said interlocking fibers are interlocking sintered fibers.

7. The apparatus as recited in claim 6, wherein said fibers consist essentially of inorganic material.

8. The apparatus as recited in claim 1, wherein said apparatus is comprised of from about 15 to about 60 of said infrared emitters.

9. The apparatus as recited in claim 1, wherein said apparatus is comprised of a manifold for supplying a mixture of gas and air to said infrared emitters.

10. The apparatus as recited in claim 1, wherein said means for igniting said mixture of gas and air is a spark source.

11. The apparatus as recited in claim 10, wherein said spark source is an igniter electrode.

* * * * *